US008695181B2

(12) United States Patent
Kaneko et al.

(10) Patent No.: US 8,695,181 B2
(45) Date of Patent: Apr. 15, 2014

(54) BUCKLE

(71) Applicant: YKK Corporation, Tokyo (JP)

(72) Inventors: Hitoshi Kaneko, Toyama (JP); Ryoichiro Uehara, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/734,529

(22) Filed: Jan. 4, 2013

(65) Prior Publication Data

US 2013/0117974 A1 May 16, 2013

Related U.S. Application Data

(63) Continuation of application No. 12/864,061, filed as application No. PCT/JP2008/050892 on Jan. 23, 2008, now Pat. No. 8,365,368.

(51) Int. Cl.
*A44B 11/25* (2006.01)

(52) U.S. Cl.
USPC ..... 24/625; 24/615

(58) Field of Classification Search
USPC ..... 24/614, 615, 625, 629, 193, 197
See application file for complete search history.

(56) References Cited

U.S. PATENT DOCUMENTS

| | | | | |
|---|---|---|---|---|
| 4,672,725 | A | 6/1987 | Kasai | |
| 5,791,026 | A | 8/1998 | Anscher | |
| 6,662,414 | B1 | 12/2003 | Niewiadomski | |
| 6,728,999 | B2 | 5/2004 | Murai et al. | |
| 6,757,944 | B2 | 7/2004 | Buscart | |
| 7,055,226 | B2 | 6/2006 | Uehara et al. | |
| 7,096,545 | B2 | 8/2006 | Uehara et al. | |
| 7,302,742 | B2 | 12/2007 | Pontaoe | |
| D597,441 | S | 8/2009 | Uehara | |
| 7,979,966 | B2 * | 7/2011 | Yoshie | 24/615 |
| 8,112,850 | B2 * | 2/2012 | Uehara | 24/615 |

(Continued)

FOREIGN PATENT DOCUMENTS

| | | |
|---|---|---|
| JP | 57-18970 Y2 | 4/1982 |
| JP | 62-111408 | 7/1987 |

(Continued)

OTHER PUBLICATIONS

International Search Report, PCT Application No. PCT/JP2008/050892, mailed May 1, 2008.

*Primary Examiner* — Robert J Sandy
*Assistant Examiner* — Michael Lee
(74) *Attorney, Agent, or Firm* — Kilpatrick Townsend & Stockton LLP

(57) ABSTRACT

A buckle includes a male member and a female member. The male member includes: a base; a pair of legs that project from the base; engaging portions that are provided on the legs to be engageable with the female member; and a linking body that links the pair of legs. The linking body includes a curved portion that is curved such that the middle thereof is closest to the base. A pair of projecting portions that are substantially parallel with an insertion direction of the male member extend from the base to be disposed outside the curved portion such that the curved portion is interposed therebetween. With this arrangement, the linking body for linking the pair of legs can be disposed with less possibility that other objects are caught in a space in the male member and without increasing a length dimension in the insertion direction more than necessary. The male member can be stably held relative to the female member against a torsion force.

9 Claims, 10 Drawing Sheets

(56) References Cited

U.S. PATENT DOCUMENTS

| | | | | |
|---|---|---|---|---|
| 8,191,213 | B2 | 6/2012 | Anscher | |
| 2002/0040514 | A1 | 4/2002 | Uehara et al. | |
| 2007/0186394 | A1 | 8/2007 | Hsiao | |
| 2009/0007391 | A1* | 1/2009 | Uehara | 24/32 |
| 2012/0198666 | A1* | 8/2012 | Nanbu et al. | 24/608 |
| 2012/0227222 | A2* | 9/2012 | Uehara et al. | 24/606 |

FOREIGN PATENT DOCUMENTS

| | | | |
|---|---|---|---|
| JP | 2000-125910 | A | 5/2000 |
| JP | 2000-166616 | A | 6/2000 |
| JP | 2001-346612 | | 12/2001 |
| JP | 2002-010804 | A | 1/2002 |
| JP | 2004-313268 | | 11/2004 |
| JP | 3790094 | | 4/2006 |

* cited by examiner

BUCKLE

This application is a continuation application of U.S. application Ser. No. 12/864,061, filed Jul. 22, 2010 which is a national stage application of PCT/JP2008/050892, both of which are incorporated herein by reference.

TECHNICAL FIELD

The invention relates to a buckle that includes a male member and a female member. Specifically, the invention relates to a buckle that is used to couple and separate a string member.

BACKGROUND ART

There has been used a buckle for coupling and separating both ends of one string member or coupling and separating two string members.

The buckle includes a male member and a tubular female member. The male member is attached to one of members, which are to be coupled with each other. The female member is attached to the other member. The male member includes: a base; a pair of legs that respectively project from both widthwise sides of the base, the pair of legs being elastically deformable in a direction intersecting an insertion direction of the male member; and engaging portions that are respectively provided on the pair of legs, the engaging portions being engageable with the female member.

When the male member is inserted in the female member, the engaging portions on the pair of legs are engaged with the female member, thereby coupling the male member with the female member. In this state, when the pair of legs of the male member, which are exposed from the female member, are elastically deformed inward, the engaging portions on the pair of legs are disengaged from the female member, so that the male member can be separated from the female member.

In the above buckle, the pair of legs project from both the widthwise sides of the base of the male member. In a state where the male member is separated from the female member, the pair of legs may be likely to be accidentally caught by other objects, so that the pair of legs may be opened widely outward to be damaged. Further, when the male member is inserted into the female member with axes of the male member and the female member shifted from each other, either one of the legs may be positioned outside the female member. As the male member is further inserted, the leg may be opened widely outward to be damaged.

As an arrangement capable of solving these problems, for instance, buckles described in Patent Documents 1 to 3 are known.

In the buckles described in Patent Documents 1 and 2, a pair of legs respectively project from both widthwise sides of a base of a male member. Inside surfaces of distal ends of the pair of legs are coupled via a linking body in an inversed V-shape whose center projects toward the base.

In the buckle described in Patent Document 3, a pair of legs respectively project from both widthwise sides of a base of a male member and a guide bar projects from a widthwise center thereof Central inside surfaces of the pair of legs are coupled via a linking body in a V-shape that extends around a distal end of the guide bar.

[Patent Document 1] JP-UM-A-61-86012

[Patent Document 1] Japanese Patent No. 3790094

[Patent Document 3] JP-A-2004-313268

DISCLOSURE OF THE INVENTION

Problems to Be Solved by the Invention

In the buckles described in Patent Documents 1 and 2, a large space is surrounded by the base, the pair of legs and the linking body, so that other objects may be easily caught therein.

In the buckle descried in Patent Document 3, the guide bar is provided between the pair of legs, thereby overcoming the above disadvantage of Patent Documents 1 and 2. However, in order to prevent the linking body that links the pair of legs from contacting with the guide bar, the linking body needs to be disposed around the distal end of the guide bar. Accordingly, it is required to increase a length dimension in the insertion direction more than necessary.

Moreover, in any one of the buckles described in Patent Documents 1 to 3, in a state where the male member is inserted in the female member to be engaged therewith, when an external force (a torsion force) is applied to the male member and the female member in a reverse rotational direction around an insertion line of the male member, the external force (the torsion force) acts on the pair of legs of the male member.

Supported portions of the pair of legs of the male member are usually formed to be thin so as to be easily elastically deformed in a direction substantially perpendicular to the insertion direction of the male member, so that it is difficult to secure a sufficient rigidity thereof against an external force. If the supported ends of the pair of legs are formed to be thick in order to secure the sufficient rigidity thereof against the external force, the pair of legs cannot be easily elastically deformed inward for disengagement of the male member from the female member, and thus operability in disengagement is reduced.

An object of the invention is to provide a buckle capable of solving such problems Specifically, an object of the invention is to provide a buckle that is less likely to catch other objects in a space surrounded by a base, a pair of legs and a linking body, in which the linking body for linking the pair of legs can be disposed without increasing a length dimension in an insertion direction more than necessary, and that can stably hold a male member relative to a female member against a torsion force.

Means for Solving the Problems

According to an aspect of the invention, a buckle includes: a male member; and a female member in which the male member is inserted to be engaged therewith, the male member including: a base to which a string member is attachable; a pair of legs that project from the base, the pair of legs being elastically deformable in a direction intersecting an insertion direction of the male member; engaging portions that are respectively provided on the legs to be engageable with the female member; a linking body that links the pair of legs and allows the legs to be elastically deformed inward, the linking body being curved such that an intermediate portion thereof is closest to the base; and a pair of projecting portions being substantially parallel with the insertion direction of the male member, the pair of projecting portions extending from the base between the intermediate portion of the linking body and the legs.

Here, "the intermediate portion" of the linking body means a portion of the linking body except both ends thereof that are linked with the pair of legs. Further, "between the intermediate portion of the linking body and the legs" means between, on a surface of the base from which the legs project, positions from which the legs project and an insertion line (a line parallel with the insertion direction) that passes through the intermediate portion (a position closest to the base) of the linking body.

With the arrangement, when the pair of legs of the male member are inserted in the female member, the engaging portions on the legs are engaged with the female member, so that the male member is coupled with the female member. In a state where the male member is coupled with the female member, when the pair of legs of the male member are elastically deformed inward, the engaging portions on the legs are disengaged from the female member, so that the male member can be separated from the female member.

Since the pair of legs are linked via the linking body in a manner to be elastically deformable inward, the pair of legs can be elastically deformed inward without any difficulty for engaging the male female with the female member and for separating the male member from the female member. Specifically, it is possible to maintain a preferable operation for engagement/disengagement and to prevent the legs from being opened widely outward to be damaged or broken.

Particularly, in the male member according to the aspect of the invention, the intermediate portion of the linking body is curved to be closest to the base and the pair of projecting portions being substantially parallel with the insertion direction of the male member extend from the base between the intermediate portion and the legs, so that the pair of projecting portions project into a space surrounded by the base, the pair of legs and the linking body. The space can thus be narrowed, thereby reducing possibility that other objects are caught in the space.

The intermediate portion of the linking body is curved to be closest to the base (i.e. a direction of the curve of the linking body is opposite as compared with that of a conventional buckle in which a guide bar is disposed at the center), thereby reducing a length dimension in the insertion direction. Moreover, even when the intermediate portion of the linking body is moved and deformed toward the base in conjunction with the inward elastic movement of the pair of legs, the pair of projecting portions, which are disposed between the intermediate portion of the linking body and the legs, cannot be an obstacle in a movement/deformation area of the linking body. Accordingly, without increasing the length dimension in the insertion direction more than necessary, the linking body for linking the pair of legs can be disposed.

The pair of projecting portions being substantially parallel with the insertion direction of the male member extend from the base between the intermediate portion of the linking body and the legs (i.e. the pair of projecting portions are disposed at an interval in the widthwise direction). Therefore, in a state where the male member is inserted in the female member to be engaged therewith, when an external force (a torsion force) is applied to the male member and the female member in a reverse rotational direction around the insertion line of the male member, the external force is received by the pair of projecting portions being in contact with the female member. It is thus possible to stably hold the male member relative to the female member against the torsion force as compared with when the external force is received only by the pair of legs.

In the aspect of the invention, it is preferable that a curved portion being curved toward the base be formed at the middle of the linking body, and the projecting portions be disposed outside the curved portion such that the curved portion is interposed therebetween.

With this arrangement, the curved portion being curved toward the base is formed at the middle of the linking body. When the legs are elastically deformed inward, the curved portion is moved toward the base while being elastically deformed to be smaller (being shrunk in diameter). Since the projecting portions are disposed outside the curved portion in a manner to interpose the curved portion therebetween, the projecting portions cannot come in contact with the linking body during the movement and deformation of the linking body.

Further, the projecting portions serve to reliably hold the male member relative to the female member against the above external force (torsion force).

In the aspect of the invention, it is preferable that the buckle further include an accommodating portion for accommodating the curved portion of the linking body between the pair of projecting portions when the pair of legs are elastically deformed inward.

With this arrangement, even when an unexpected external force (e.g. an external force acting in an opposite direction to the insertion direction) acts on the linking body, the curved portion of the linking body is accommodated and held in the accommodating portion, thereby preventing the curved portion of the linking body from being moved to another position to be broken.

In the aspect of the invention, it is preferable that the base include a base-side projection in which a widthwise center thereof farther projects in a projection direction of the pair of legs relative to widthwise ends thereof from which the pair of legs project.

With this arrangement, the widthwise center of the base projects in the projection direction of the pair of legs relative to the widthwise ends of the base from which the pair of legs project to provide the base-side projection. Accordingly, the projecting portions respectively extend from both sides of a distal end of the base-side projection. Thus, even when the length of the projecting portions is short, the male member can be held relative to the female member at a position near the center of the male member. The base-side projection also serves to further narrow the space surrounded by the base, the pair of legs and the linking body, thereby reducing possibility that other objects are caught in the space.

In the aspect of the invention, it is preferable that the female member include a restricting portion that is in contact with side surfaces of the projecting portions to restrict a widthwise movement of the projecting portions.

With this arrangement, even when a widthwise external force is applied to the male member, the movement of the projecting portions is restricted by the restricting portion provided to the female member and the external force is received by the projecting portions, thereby reducing the external force acting on the pair of legs.

BEST MODE FOR CARRYING OUT THE INVENTION

Exemplary of the invention will be described below with reference to the drawings.

First Exemplary Embodiment

Structure of First Exemplary Embodiment

Figure 1:
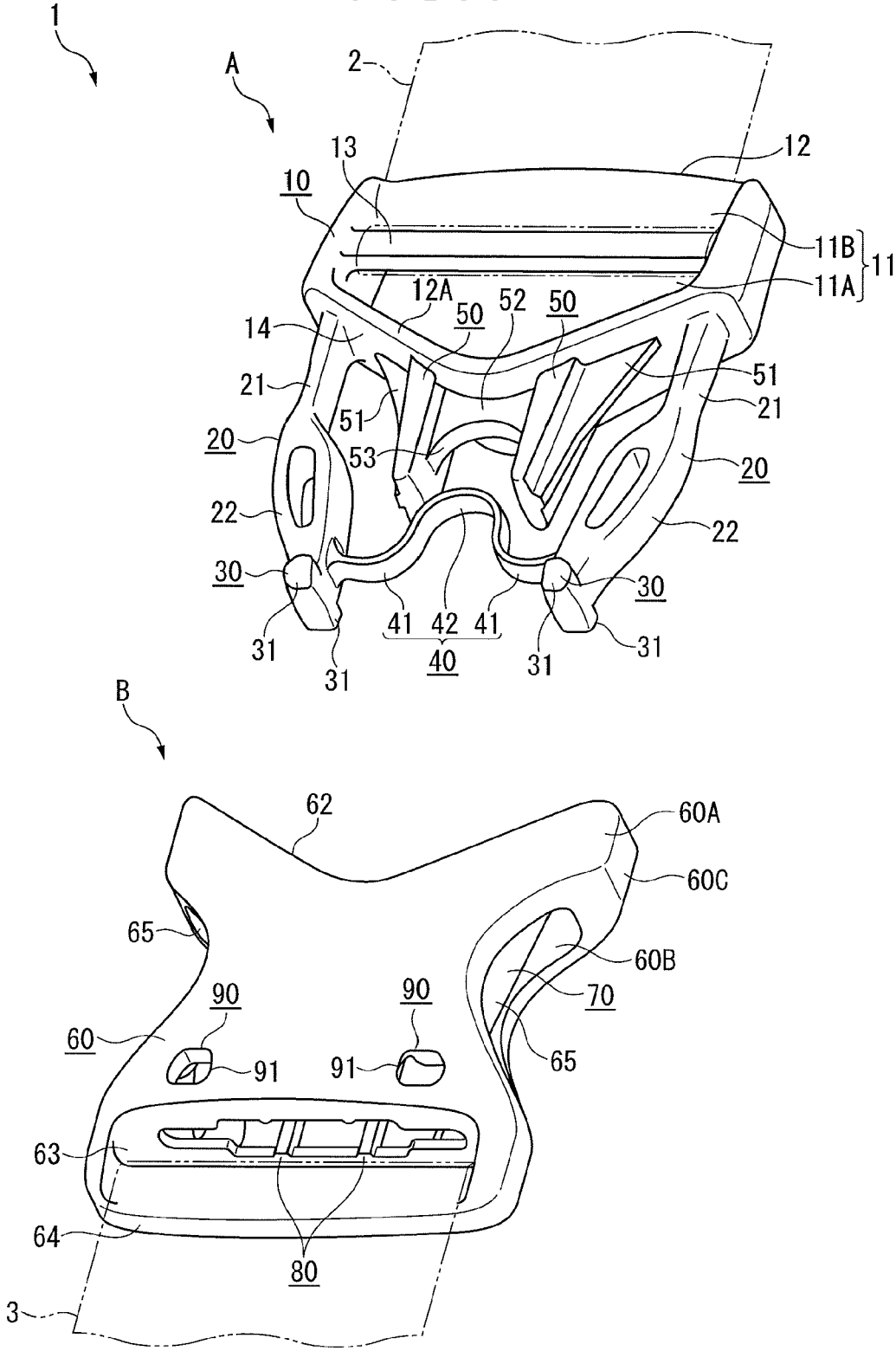
FIG. 1 is a perspective view showing a buckle in disengagement according to a first exemplary embodiment of the invention.
Figure 2:
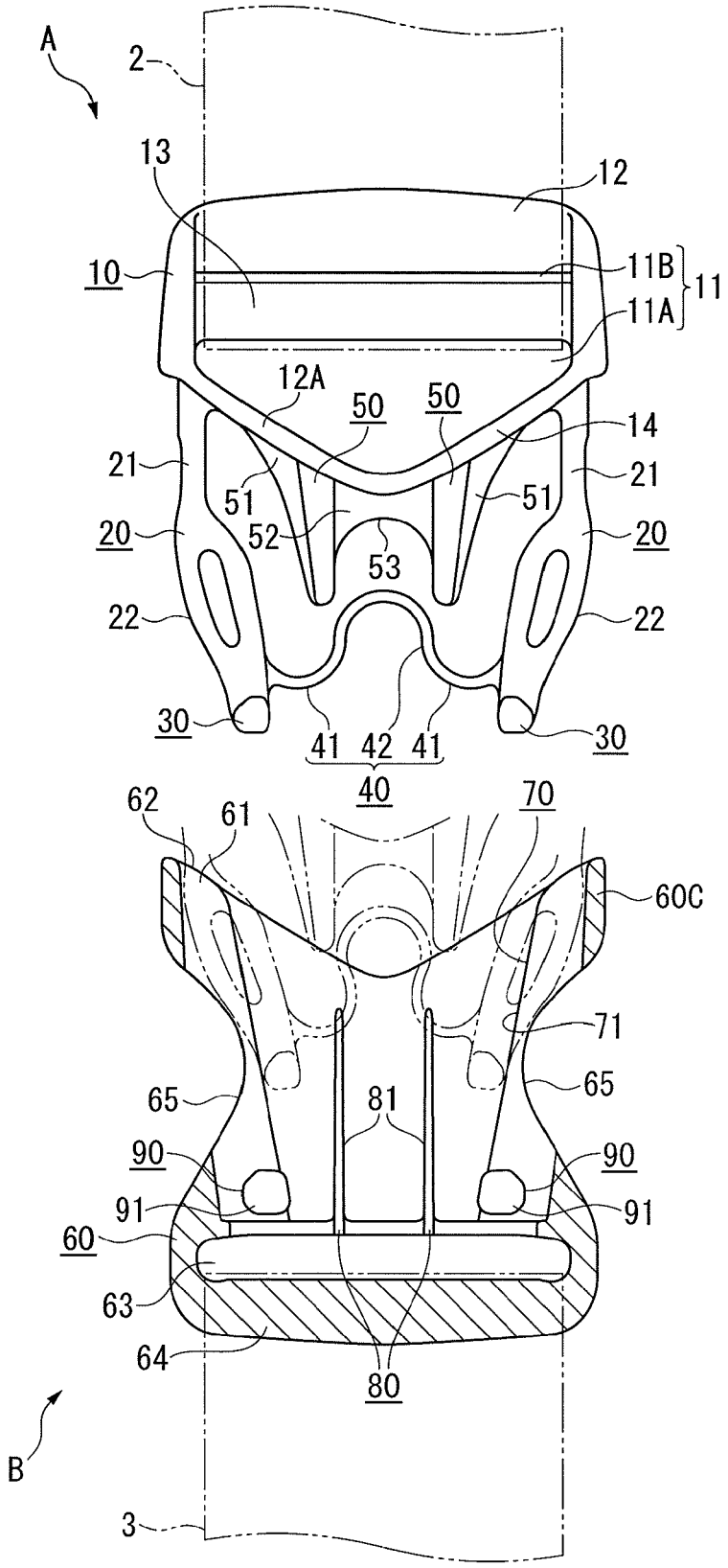
FIG. 2 is a partially-cutaway plan view showing the buckle in disengagement in the above exemplary embodiment.
Figure 3:
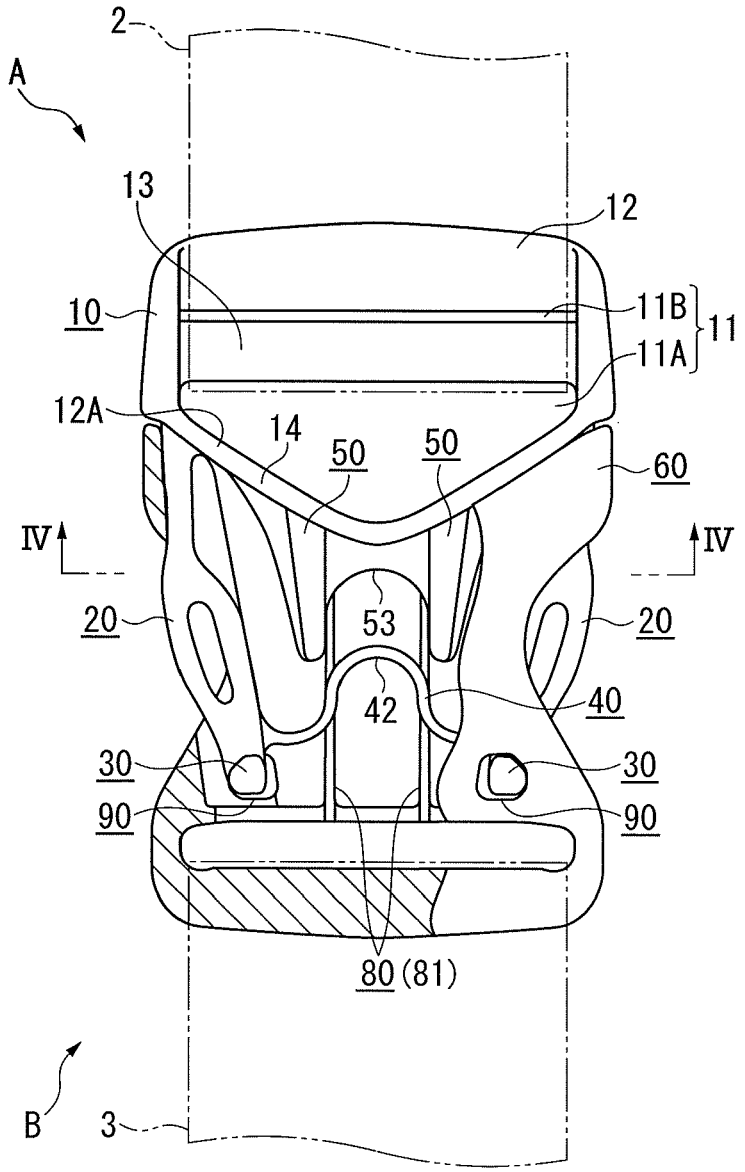
FIG. 3 is a partially-cutaway plan view showing the buckle in engagement in the above exemplary embodiment.

FIG. 1 is a perspective view showing a buckle in disengagement according to a first exemplary embodiment. FIG. 2 is a partially-cutaway plan view showing the buckle in disengagement. FIG. 3 is a partially-cutaway plan view showing the buckle in engagement.

As shown in these figures, the buckle 1 according to the first exemplary embodiment for coupling and separating ends 2 and 3 of a string member includes a male member A being integrally formed of a synthetic resin and a female member B also being integrally formed of a synthetic resin and into which the male member A is inserted to be engaged therewith. Materials of the male member A and female member B are not limited to the synthetic resin, but may be other materials such as metal.

The male member A includes: a base 10; a pair of legs 20 that project in substantially parallel with each other from both widthwise sides of the base 10 (a widthwise direction being perpendicular to an insertion direction of the male member A) in a lengthwise direction of the base 10 (the insertion direction of the male member A), the pair of legs 20 being elastically deformable in a direction intersecting the insertion direction of the male member A (here, in widthwise directions approaching or separating from each other), engaging portions 30 being respectively provided to distal ends of the legs 20 to be engageable with the female member B; a linking body 40 that links the pair of legs 20 and allows the legs 20 to be elastically deformed inward; and a pair of projecting portions 50 that are integrally formed with and extend from the base 10 between an intermediate portion of the linking body 40 and the legs 20, the pair of projecting portions 50 being substantially parallel with the insertion direction of the male member A.

The base 10 includes a substantially-pentagonal shaped frame 12 having at the middle of the inside thereof a string attachment hole 11 (a string attachment portion) into which the end 2 of the string member is inserted to be latched therein.

A connecting bar 13 is bridged in a widthwise direction of the frame 12 at the middle of the string attachment hole 11 relative to the insertion direction. The connecting bar 13 partitions the string attachment hole 11 into two string attachment holes 11A, 11B respectively near a front end relative to the insertion direction in which the legs 20 are formed and near a rear end relative to the insertion direction opposite to the front end. Thus, the string member can be inserted into the string attachment holes 11A, 11B and folded around the connecting bar 13, thereby adjusting the length of the string member.

The frame 12 includes a V-shaped frame member 12A to which the legs 20 are provided, the frame member 12A having a center projecting farther in a projection direction of the legs 20 as compared with both ends thereof In other words, the base 10 includes a V-shaped base-side projection 14 whose projecting amount gradually increases in a projection direction of the legs 20 toward the widthwise center thereof relative to both widthwise ends thereof from which the pair of legs 20 project.

The individual leg 20 includes an elastic piece 21 and a guide piece 22. The elastic leg piece 21 linearly extends in the insertion direction of the male member A from the widthwise side of the base 10 and is elastically deformable in the directions approaching or separating from the other elastic piece 21. The guide piece 22 extends from a distal end of the elastic piece 21 in the insertion direction of the male member A.

In a cross section of the elastic piece 21, a dimension in an elastically deforming direction (widthwise dimension) is smaller than a dimension in a top-bottom direction.

The guide piece 22 is bifurcated from the elastic piece 21 and then merged at a distal end thereof. The guide piece 22 has an outer side surface that is sloped inward toward the distal end thereof, i.e., in a direction such that the pair of legs 20 approach each other.

The engaging portions 30 include protrusions 31 that project respectively at top and bottom surfaces of a distal end of the guide piece 22 of the pair of legs 20.

The individual protrusion 31 includes surrounding walls such as an inner side wall, a front side wall, a front-outer side wall, a rear-outer side wall and a rear side wall and is formed in a substantially-pentagonal shape in which corners of adjacent ones of these walls are coupled by arc surfaces.

The linking body 40 serves to prevent the pair of legs 20 from being deformed outward beyond a predetermined range, thereby preventing the legs 20 from being damaged when an excessive pulling force (outwardly pulling force) is applied to the legs 20. The linking body 40 is curved such that the intermediate portion thereof is closest to the base 10. Specifically, the linking body 40 includes: parallel portions 41 each extending in a direction substantially parallel with the widthwise direction from a distal inner sidewall of one of the legs 20 toward a portion, from which the linking body 40 rises, of a distal inner side wall of the other leg 20; and a curved portion 42 being continuously formed from inner ends of the parallel portions 41 and being curved in an inverted U-shape toward the base 10. The direction of curvature of the middle portion of the linking body is opposite to a direction of curvature near the parallel portions of the linking body along both an inner surface and an outer surface of the linking body. The parallel portions 41 and the curved portion 42 are symmetrically formed relative to an insertion-directional center axis at a widthwise center of the linking body 40.

The curved portion 42 is elastically deformable in such a manner that when the pair of legs 20 are elastically deformed inward, a diameter of the curved portion 42 is shrunk such that an opening of the inversed U-shaped is closed and, in contrast, when the pair of legs 20 are elastically deformed outward, the diameter of the curved portion 42 is increased such that the opening of the inversed U-shaped is open.

When the pair of legs 20 are elastically deformed, the inner ends of the parallel portions 41, which are connected to the curved portion 42, are elastically deformed toward the base 10, thereby promoting the shrinkage of the diameter of the curved portion 42.

The projecting portions 50 extend from the base 10 in substantially parallel with the insertion direction of the male member A between the intermediate portion of the linking body 40 (except both the ends) and the legs 20 (in this exemplary embodiment, between the center of the linking body 40 and the legs 20) and at positions outside the curved portion 42 between which the curved portion 42 is interposed. In other words, the projecting portions 50 are positioned so as not to interfere with the curved portion 42 and the parallel portions 41 of the linking body 40 when the linking body 40 is elastically deformed and so as to be close to the widthwise center.

Incidentally, the positions outside the curved portion 42 of the linking body 40 between which the curved portion 42 is interposed is positions outside the insertion-directional axes passing through widthwise outermost ends of the curved portion 42.

Figure 4:
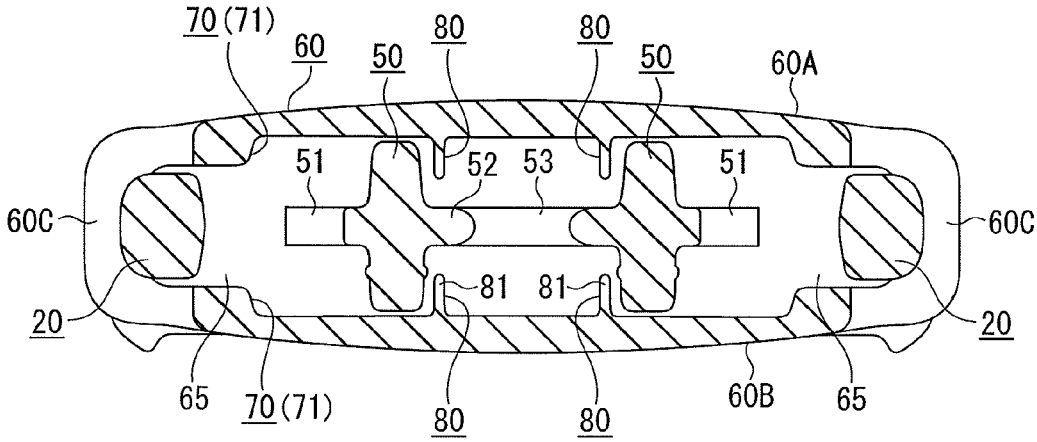
FIG. 4 is an enlarged cross sectional view taken along the line IV-IV in FIG. 3.

As shown in FIG. 4, the individual projecting portion 50 has a thicknesswise dimension (a dimension between top and bottom surfaces thereof) enough to contact with inner walls of the female member B (top wall 60A and bottom wall 60B, both described later) and is formed in a shape having a rectangular cross section larger than a widthwise dimension thereof Ribs 51, 52 are integrally formed on the inner and outer side surfaces of the projecting portions 50. The ribs 51 are integrally formed in a substantially triangular shape along the outer side surfaces of the projecting portions 50 and slant surfaces of the base-side projection 14 of the base 10, respectively. The rib 52 on the inner side of the projecting portion 50 is integrally formed at a corner between a distal edge of the base-side projection 14 of the base 10 and the inner side surface of the projecting portion 50. An accommodating portion 53 in the shape of a semicircle groove is formed by being surrounded by the rib 52 and the projecting portions 50.

The accommodating portion 53 is formed to have a size enough to accommodate the curved portion 42 of the linking body 40 between the pair of projecting portions 50 when the pair of legs 20 are elastically deformed inward.

The female member B includes a flat hollow female member body 60 that has a top wall 60A that defines a top surface, a bottom wall 60B that defines a bottom surface, and a pair of lateral walls 60C that connects the top wall 60A and the bottom wall 60B.

On a distal end of the female member body 60, an insertion opening 61 into which the pair of legs 20 of the male member A are inserted is provided and an abutment portion 62 that is abutted against the base-side projection 14 of the male member A is formed. The abutment portion 62 is formed in a V-shape that coincides with that of the base-side projection 14 of the male member A.

On a proximal end of the female member body 60, a string attachment hole 63 (a string attachment portion) in which the end 3 of the string member is inserted to be latched therein and a connecting bar 64 are formed. In addition, an opening 65 is formed in a concave shape by cutting off an intermediate portion of the individual lateral wall 60C. The guide pieces 22 provided to the legs 20 of the male member A are exposed in the openings 65, so that the guide pieces 22 can be pressed inward toward each other. In other words, the guide pieces 22 are also used as an operation portion for disengaging the male member A from the female member B.

The female member body 60 includes therein: a guide member 70 being formed from the insertion opening 61 into the female member body 60 to elastically deform the distal ends of the pair of legs 20 in the directions approaching each other while guiding the engaging portions 30 of the male member A; a restricting portion 80 being formed from near the insertion opening 61 toward a rear end of the female member body 60 to restrict a widthwise movement of the pair of projecting portions 50; and a pair of to-be-engaged portions 90 being formed on both sides of a rear end of the guide member 70 to be respectively engaged with the engaging portions 30.

The guide member 70 includes a guide groove 71 formed on the inner surfaces of the top wall 60A and the bottom wall 60B of the female member body 60. The guide groove 71 is formed in a tapered shape whose width is gradually narrowed from the insertion opening 61 toward the to-be-engaged portions 90.

The restricting portion 80 includes a pair of parallel projected treads 81 formed on the inner surfaces of the top wall 60A and the bottom wall 60B of the female member body 60 from near the insertion opening 61 toward the rear end thereof When the male member A is inserted in the female member B, the pair of projected treads 81 are guided to be positioned outside the projecting portions 50.

The to-be-engaged portion 90 includes recesses 91 for moving the engaging portions 30 in the directions separating from each other.

The recesses 91 are substantially-pentagonal concave grooves formed by cutting off the inner surfaces of the top wall 60A and the bottom wall 60B of the female member body 60 in a direction substantially perpendicular to the insertion direction of the male member A from the rear end of the guide groove 71 to both outer sides thereof

Effects and Advantages of First Exemplary Embodiment

When the pair of legs 20 of the male member A are inserted from the insertion opening 61 of the female member B, as shown by a chain line in FIG. 2, the engaging portions 30 provided on the distal ends of the legs 20 are guided by the guide groove 71 to be inserted into the female member B and the distal ends of the pair of legs 20 are elastically deformed in the directions approaching each other.

When the engaging portions 30 eventually reach the to-be-engaged portions 90 beyond the guide groove 71, the engaging portions 30 each are moved in the directions separating from each other by an elastic restoring force of the pair of legs 20 to be engaged with the to-be-engaged portions 90 set at the rear end along the separating directions. In other words, the male member A is coupled with the female member B.

In a state where the male member A is coupled with the female member B, the top and bottom surfaces of the pair of projecting portions 50 in the male member A are substantially in contact with the inner walls of the female member B (the inner walls of the top wall 60A and the bottom wall 60B) as shown in FIG. 4, thereby restricting movement of the male member A in the top-bottom direction. The projecting portions 50 in contact with the inner wall of the female member B also serves to reduce an external force acting on the pair of legs 20 in the top-bottom direction.

Simultaneously, since the inner side surfaces of the pair of projecting portions 50 are respectively disposed outside the projected treads 81 of the female member B, movement of the male member A in the widthwise direction is restricted. The projecting portions 50 are in contact with the projected treads 81 of the male member B, thereby reducing an external force acting on the pair of legs 20 in the widthwise direction.

In order to disengage the male member A from the female member B while the male member A and the female member B are coupled with each other, the outer side surfaces of the guide pieces 22 of the legs 20, which project from the openings 65 of the female member B are pressed inward. The legs 20 of the male member A are elastically deformed inward, so that the engaging portions 30 are disengaged from the to-be-engaged portions 90. In this state, by pulling the male member A out of the female member B, the male member A can be separated from the female member B.

Figure 5:
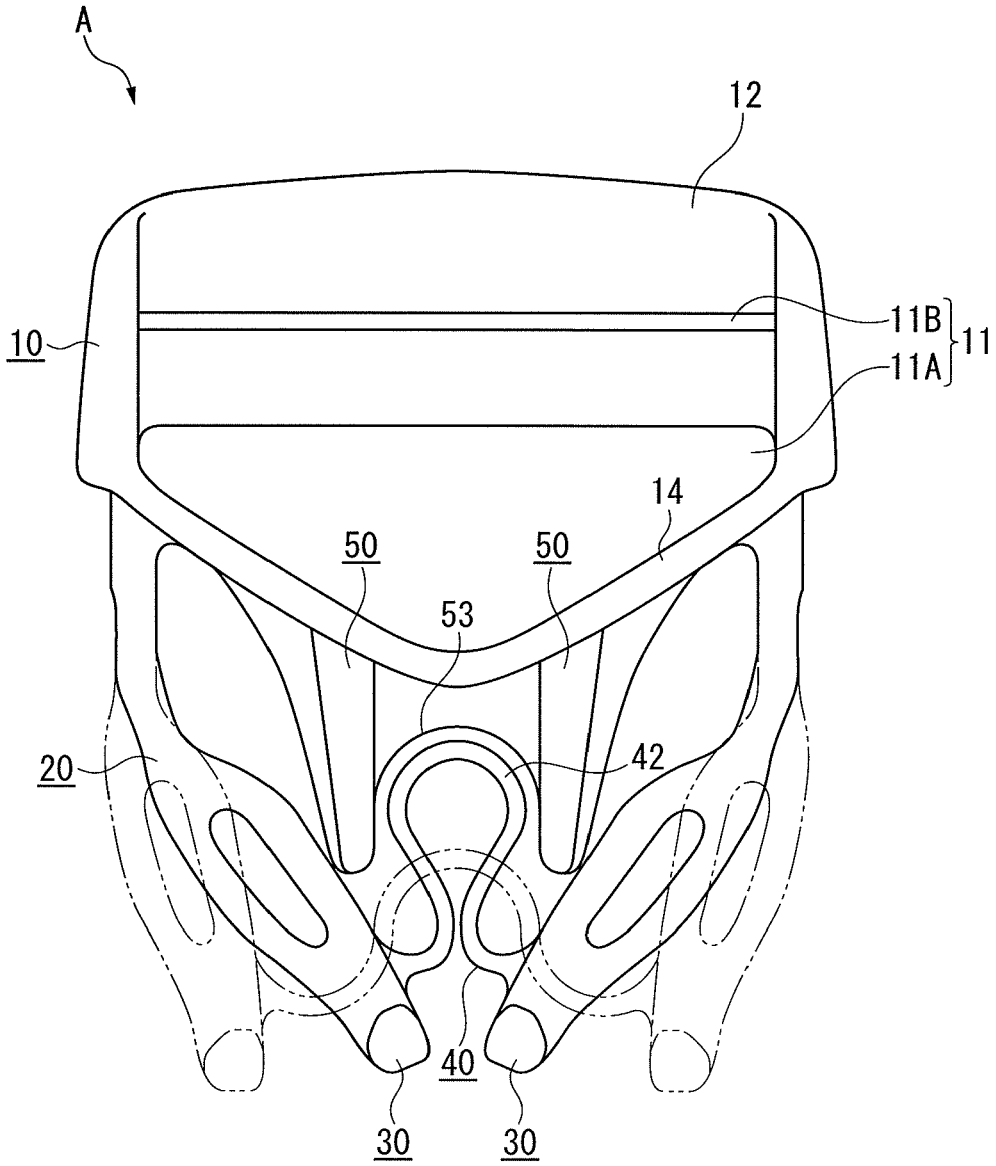
FIG. 5 shows a state in which legs of a male member are elastically deformed in the above exemplary embodiment.

In this exemplary embodiment, as shown in FIG. 5, when the pair of legs 20 are elastically deformed inward, the diameter of the curved portion 42 is shrunk while the curved portion 42 of the linking body 40 are moved toward the base 10. In other words, since such a reduction in the diameter of the curved portion 42 of the linking body 40 allows the pair of legs 20 to be elastically deformed inward, concentration of stress on joints between both the ends of the linking body 40 and the legs 20 can be avoided to provide less breakable structure.

When the pair of legs 20 are elastically deformed inward to nearly contact with the projecting portions 50, the curved portion 42 of the linking body 40 is accommodated in the accommodating portion 53. With this arrangement, even when an unexpected external force (e.g. an external force acting in an opposite direction to the insertion direction) acts on the linking body 40, the curved portion 42 of the linking body 40 is prevented from moving to another position to be broken.

Figure 6:
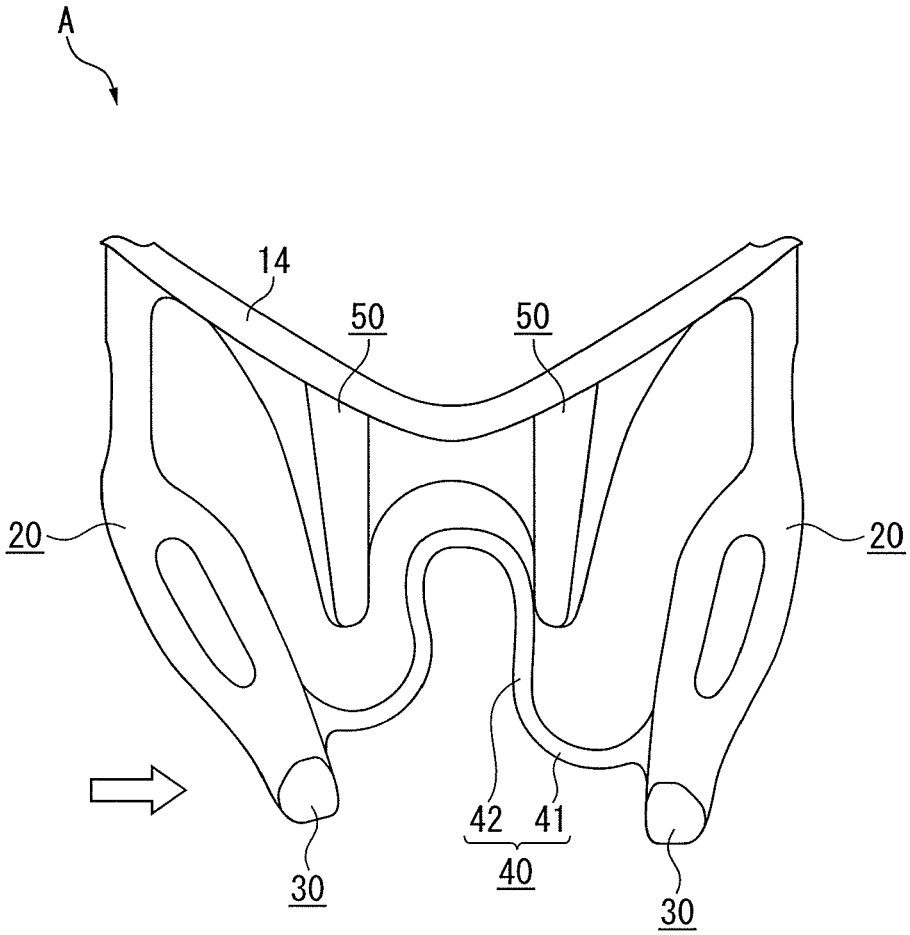
FIG. 6 shows a state in which one of the legs of the male member are is deformed in the above exemplary embodiment.

As shown in FIG. 6, when an external force acts on one of the legs 20 from the outside, the leg 20 is elastically deformed inward and the curved portion 42 is also deformed in the same direction. The curved portion 42 is brought into contact with the projecting portions 50 to restrict further inward elastic deformation of the leg 20, thereby providing less breakable structure against the external force acting from the outside of the leg 20.

Particularly, in the male member A according to this exemplary embodiment, the curved portion 42 being curved toward the base 10 is formed at the middle of the linking body 40 and the pair of projecting portions 50 extend from the base 10 outside the curved portion 42 in a manner to interpose the curved portion 42 therebetween, and therefore the pair of projecting portions 50 project into a space surrounded by the base 10, the pair of legs 20 and the linking body 40. With this arrangement, the space can be narrowed, thereby reducing possibility that other objects are caught in the space.

The linking body 40 is provided with the curved portion 42 being curved toward the base (i.e. a direction of the curve of the linking body 40 is opposite to that of a conventional buckle in which a guide bar is disposed at the center), thereby reducing a length dimension in the insertion direction. Further, even when the curved portion 42 of the linking body 40 is elastically deformed with the diameter thereof getting shrunk while being moved toward the base 10 during the inward elastic movement of the pair of legs 20, the pair of projecting portions 50, which are disposed outside the curved portion 42 of the linking body 40, are prevented from being an obstacle in a movement-deformation area of the linking body 40. Accordingly, without increasing the length dimension in the insertion direction more than necessary, the linking body 40 for linking the pair of legs 20 can be disposed.

The pair of projecting portions 50 are disposed at an interval in the widthwise direction of the base 10, and thus it is possible to stably hold the male member A relative to the female member B against a torsion force. Specifically, in the state where the male member A is inserted in the female member B to be engaged therewith, when an external force (a torsion force) is applied to the male member A and the female member B in a reverse-rotational direction around the insertion line, the pair of projecting portions 50, which are in contact with the female member B, also receive the external force, thereby stably holding the male member A relative to the female member B against the torsion force as compared with when the external force is received only by the pair of legs 20.

The base 10 includes the base-side projection 14 in which the widthwise center projects farthest in the projection direction of the pair of legs 20 relative to the widthwise ends from which the pair of legs 20 project, and therefore the projecting portions 50 respectively extend from both the sides of the distal end of the base-side projection in a manner to interpose the distal end therebetween. Thus, even when the length of the projecting portions 50 is short, it is possible to stably hold the male member A relative to the female member B at a position near the center of the male member A.

The base-side projection 14 also serves to narrow the space surrounded by the base 10, the pair of legs 20 and the linking body 40, thereby reducing possibility that other objects are caught in the space.

Second Exemplary Embodiment

Figure 7:
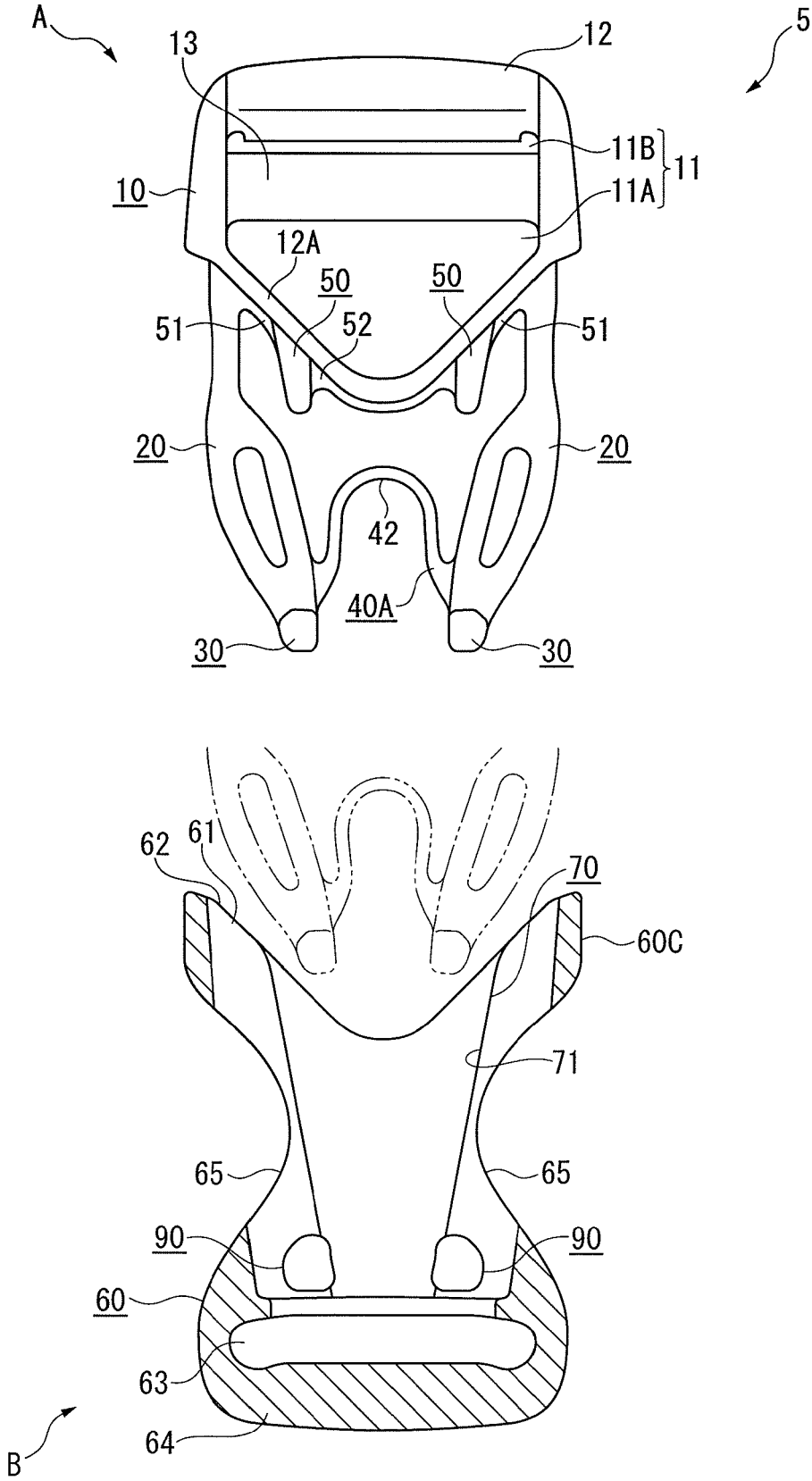
FIG. 7 is a partially-cutaway plan view showing a buckle in disengagement according to a second exemplary embodiment of the invention.
Figure 8:
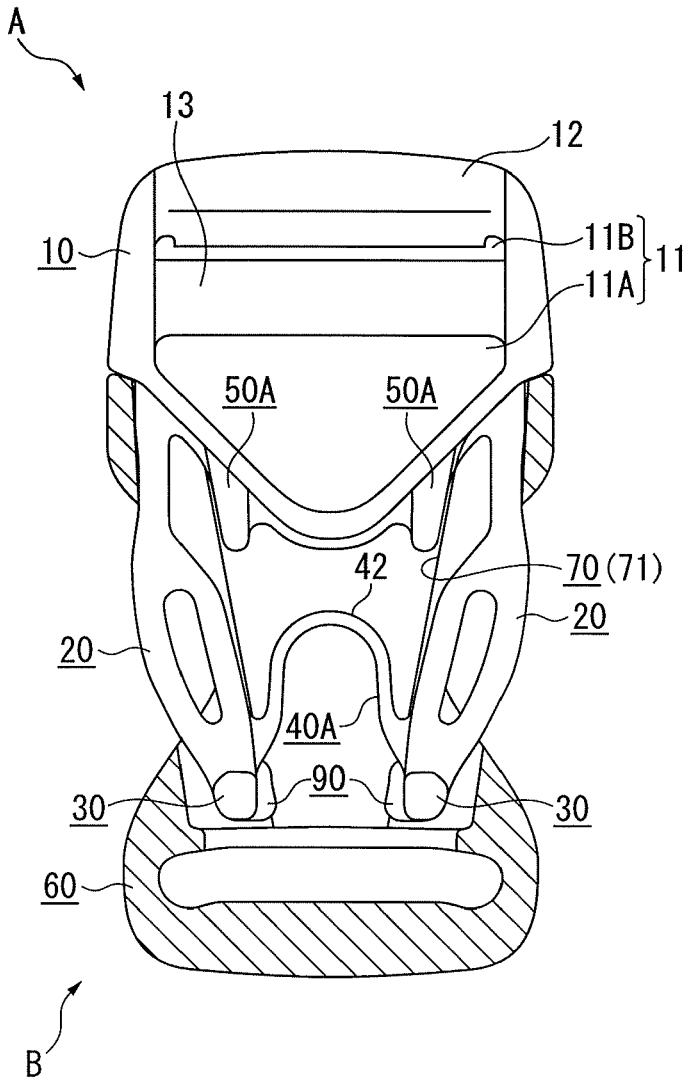
FIG. 8 is a partially-cutaway plan view showing the buckle in engagement in the above exemplary embodiment.
Figure 9:
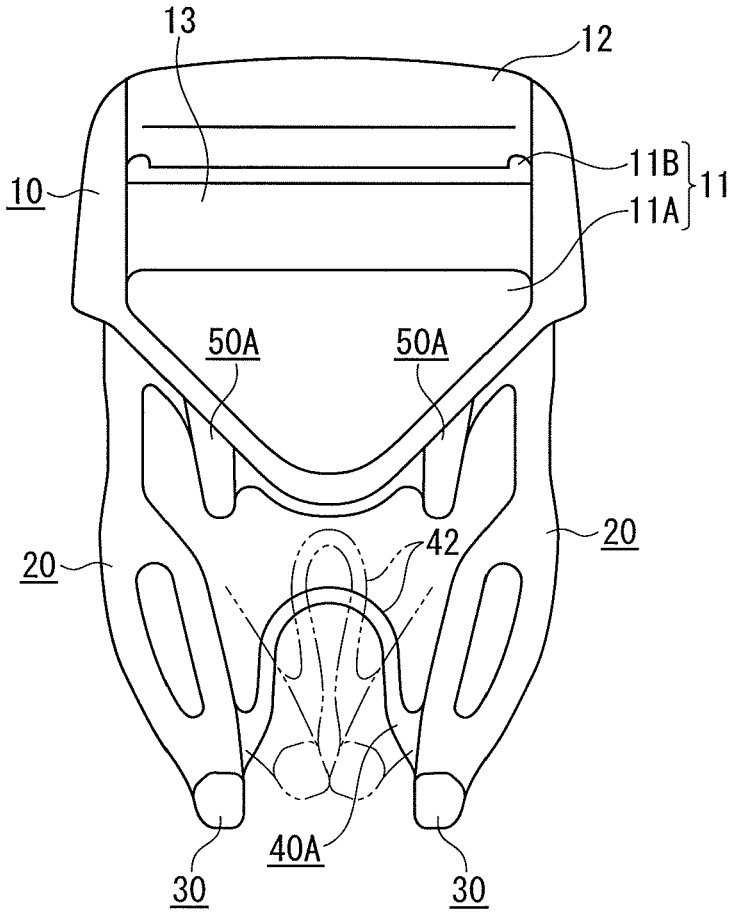
FIG. 9 shows a state in which legs of a male member are elastically deformed in the above exemplary embodiment.

FIG. 7 is a partially-cutaway plan view showing a buckle in disengagement according to a second exemplary embodiment. FIG. 8 is a partially-cutaway plan view showing the buckle in engagement. FIG. 9 shows the buckle when the legs are deformed inward. In the following description of these figures, the same elements as the first exemplary embodiment will be denoted by the same reference symbols, and the description thereof will be omitted or simplified.

As shown in these figures, a buckle 5 according to the second exemplary embodiment is different in the structure of the linking body and the projecting portions from the buckle 1 according to the first exemplary embodiment.

A linking body 40A according to the second exemplary embodiment is curved in an inverted U-shape that extends from the inside surfaces of the distal ends of the pair of legs 20 such that the center thereof is closest to the base 10. Specifically, the parallel portions 41 of the linking body 40 according to the first exemplary embodiment is omitted.

Projecting portions 50A according to the second exemplary embodiment are shorter in length and are disposed further outside in the widthwise direction as compared with the projection portions 50 according to the first exemplary embodiment. Specifically, as shown in FIG. 9, even when the pair of legs 20 are elastically deformed extremely inward, the projection portions 50A are disposed at positions in which the projection portions 50A are not in contact with the curved portion 42 of the linking body 40A.

The outer side surfaces of the projecting portions 50A are formed as sloped surfaces being fitted in the guide grooves 71 of the female member B. Thus, without the projected treads 81 that are provided to the female member B in the first exemplary embodiment, the widthwise movement can be restricted. In other words, in this exemplary embodiment, the guide groove 71 also serves as the restricting portion 80 in place of the projected treads 81. Even when an external force is applied from the widthwise direction, since the external force is received by the projecting portions 50A being in contact with the guide groove 71, the influence of the external force on the legs 20 can be reduced.

Modifications

It should be noted that the invention is not limited to the buckle having the arrangement described in the above exemplary embodiments, but includes modifications below.

In the above exemplary embodiments, the linking body 40 includes the curved portion 42 in the inversed U-shape, but the shape is not limited thereto. The shape may be, for instance, an inversed V-shape in which the intermediate portion is closest to the base 10 and the top thereof is rounded, or a parabolic shape in which the center thereof is the closest to the base 10.

The curved portion 42 is in the inversed U-shape in which the center of the linking body 40 is closest to the base 10, but a position shifted from the center of the linking body 40 toward either end thereof may be closest to the base 10.

In the above exemplary embodiment, the pair of projecting portions 50 extend between the intermediate portion of the linking body 40 and the legs 20, but at least two projecting portions 50 are sufficient, and therefore three or more may be provided.

In the above exemplary embodiments, the guide groove 71 is formed inside the female member body 60 from the insertion opening 61 toward the to-be-engaged portions 90 such that the engaging portions 30 are guided by the guide groove 71, thereby elastically deforming the distal ends of the pair of legs 20 in the directions approaching each other, but the guide portion 70 for elastically deforming the pair of legs in the directions approaching each other is not limited thereto.

Figure 10:
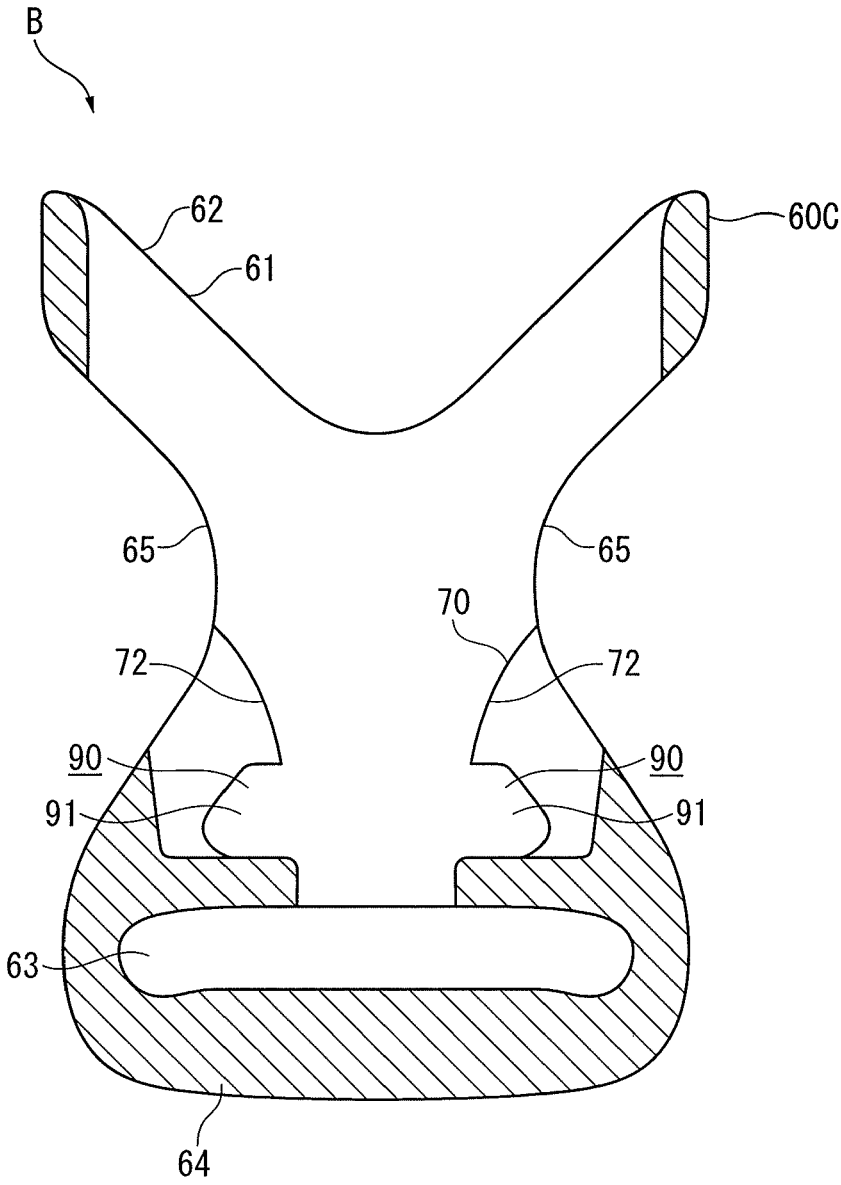
FIG. 10 is a cross sectional view showing a modification of a female member.

As shown in FIG. 10, for instance, protrusions 72 or the like may be provided inside the female member body 60. The protrusions 72 are in contact with the engaging portions 30 to elastically deform the distal ends of the pair of legs 20 in the directions approaching each other and then elastically restore the distal ends in the directions separating from each other.

In the above exemplary embodiments, the recesses 91 formed in the top wall 60A and the bottom wall 60B are respectively open in the outer surfaces of the top wall 60A and the bottom wall 60B, but the arrangements of recesses 91 are not limited thereto. As shown in FIG. 10, for instance, both the recesses 91 or either one of the recesses 91 may be formed to the substantially same depth of the protrusions 72 or a bottom wall of the guide groove 71 without being open in the outer surface(s) of the top wall 60A and/or the bottom wall 60B. In this manner, since no opening is formed in the outer surface(s) of the top wall 60A and/or the bottom wall 60B, it is possible to prevent a foreign substance from entering through the opening and to simplify the design thereof.

In the above exemplary embodiments, the V-shaped base-side projection 14 and the V-shaped abutment portion 62, which are respectively provided to the male member A and the female portion B, are abutted with each other, but the shape of these to-be-abutted portions is not limited to the V-shape. Accordingly, the shape may be, for instance, a U-shape, a trapezoidal shape, a rectangular shape or a flat surface parallel with the widthwise direction.

In the above exemplary embodiments, the male member A and the female member B are respectively provided with the string attachment holes 11, 63 as the string attachment portions, but the female member B may not be provided with the string attachment hole 63.

In other words, the female member body 60 of the female member B may be fixed directly to another member.

A connecting bar may be bridged in a widthwise direction of the string attachment hole 63 of the female member B to make the length of the string member adjustable.

The string member may be a thin string having a small width without being limited to a belt-like string.

Preferable exemplary embodiments and various modifications of the invention have been exemplified above, but it should be noted that these embodiments and modifications may be employed in combination.

The invention claimed is:

1. A male buckle member comprising:

a base adapted for attachment to a string member;

a pair of legs that project from the base, the pair of legs capable of being elastically deformable in a direction intersecting an insertion direction of the male buckle member;

a pair of projecting portions being substantially parallel with the legs, the pair of projecting portions extending from the base between the legs;

a linking body that links the pair of legs, wherein an intermediate portion of the linking body is formed at a middle of the linking body and extends closer to the base than portions of the linking body attached to the legs; and an accommodating portion formed by the projecting portions adapted to accommodate the intermediate portion of the linking body between the projecting portions when the pair of legs are elastically deformed inward.

2. The male buckle member of claim 1, wherein each of the projecting portions includes an outer rib formed on an outer side surface of the projecting portion.

3. The male buckle member of claim 2, wherein each of the outer ribs has a substantially triangular shape.

4. The male buckle member of claim 1, wherein each of the projecting portions has a rectangular cross-section with a thicknesswise dimension larger than a widthwise dimension.

5. The male buckle member of claim 1, wherein an inner rib connects inner side surfaces of the projecting portions.

6. A male buckle member comprising:

a base adapted for attachment to a string member;

a pair of legs that project from the base, the pair of legs capable of being elastically deformed in a direction intersecting an insertion direction of the male buckle member;

a linking body that links the pair of legs, wherein the linking body includes a pair of end portions each extending in a direction towards each other from an inner side wall of one of the legs and a curved portion between the pair of end portions, wherein the curved portion is curved towards the base and extends closer to the base than the end portions, wherein the curved portion is continuously formed from inner ends of each of the end portions, and wherein a direction of curvature of a middle portion of the linking body is opposite to a direction of curvature near the end portions of the linking body along both an inner surface and an outer surface of the linking body; and protrusions that project from top and bottom surfaces of each of the legs at ends of the legs farthest from the base, wherein each of the legs includes an elastic piece that extends from the base and a guide piece that extends from a distal end of the elastic piece, and wherein a portion of the guide piece is bifurcated, wherein the protrusions provided on each of the legs are disposed so that a distance between the protrusions is less than a distance between the legs at the base, and wherein the end portions extend from the inner side walls of the legs at points that are closer to the base than the protrusions.

7. The male buckle member of claim 6, wherein a cross section of each elastic piece is smaller in a widthwise dimension than in a top-bottom direction.

8. The male buckle member of claim 6, wherein each of the protrusions comprises a plurality of walls with adjacent walls connected by arc surfaces.

9. The male buckle member of claim 6, wherein the pair of end portions extends substantially in parallel with a width direction of the male buckle member.

* * * * *

UNITED STATES PATENT AND TRADEMARK OFFICE

CERTIFICATE OF CORRECTION

PATENT NO. : 8,695,181 B2
APPLICATION NO. : 13/734529
DATED : April 15, 2014
INVENTOR(S) : Hitoshi Kaneko et al.

It is certified that error appears in the above-identified patent and that said Letters Patent is hereby corrected as shown below:

In the Specification

In column 1, line 62, Delete “thereof” and insert -- thereof. --, therefor.

In column 6, line 7, Delete “thereof” and insert -- thereof. --, therefor.

In column 6, line 44, Delete “sidewall” and insert -- side wall --, therefor.

In column 7, line 23, Delete “thereof” and insert -- thereof. --, therefor.

In column 8, line 15, Delete “thereof” and insert -- thereof. --, therefor.

In column 8, line 27, Delete “thereof” and insert -- thereof. --, therefor.

Signed and Sealed this
Ninth Day of September, 2014

Michelle K. Lee

Michelle K. Lee
*Deputy Director of the United States Patent and Trademark Office*